United States Patent [19]

Brown

[11] Patent Number: 4,780,587

[45] Date of Patent: Oct. 25, 1988

[54] OVERLAP SEAM FOR MICROWAVE INTERACTIVE PACKAGE INSERT

[75] Inventor: Richard K. Brown, Hortonville, Wis.

[73] Assignee: James River Corporation, Richmond, Va.

[21] Appl. No.: 79,430

[22] Filed: Jul. 30, 1987

[51] Int. Cl.[4] ..... H05B 6/80

[52] U.S. Cl. ..... 219/10.55 E; 219/10.55 F; 426/107; 426/243; 99/DIG. 14

[58] Field of Search ..... 219/10.55 E, 10.55 F, 219/10.55 R, 10.55 M; 99/DIG. 14, 451; 426/243, 241, 234, 107, 113, 114; 126/390

[56] References Cited

U.S. PATENT DOCUMENTS

| | | | |
|---|---|---|---|
| 3,394,007 | 7/1968 | Campbell | 426/107 X |
| 4,267,420 | 5/1981 | Brastad | 219/10.55 E |
| 4,292,332 | 9/1981 | McHam | 426/234 X |
| 4,590,349 | 5/1986 | Brown et al. | 219/10.55 E |
| 4,594,492 | 6/1986 | Maroszek | 219/10.55 E |
| 4,641,005 | 2/1987 | Seiferth | 219/10.55 E |

*Primary Examiner*—Philip H. Leung

*Attorney, Agent, or Firm*—Sixbey, Friedman, Leedom & Ferguson

[57] ABSTRACT

A microwave insert for use in an outer microwave transparent carton for surface heating an object, such as a food product, in a microwave oven. The insert includes a flexible layer of interactive material for converting microwave energy into heat, and a support material, preferably a semi-rigid microwave transparent material such as paperboard, for supporting the interactive material in a position adjacent one portion of the surface of the object in a configuration to minimize the amount of overlaps of interactive material. The overlap is provided along a base panel spaced from the folds which define the base panel and is restricted to a zone wherein the overlap zone is positioned to utilize the maximum possible amount of microwave shielding by the object when the object and the insert are located in operative position within a microwave oven.

18 Claims, 2 Drawing Sheets

OVERLAP SEAM FOR MICROWAVE INTERACTIVE PACKAGE INSERT

TECHNICAL FIELD

This invention relates generally to the packaging of food products to be heated in a microwave oven, and more particularly to an apparatus for surface heating a broad range of food products, such as buns, waffles, pizzas or pies.

BACKGROUND ART

The combination of microwave cooking and preprocessed food products would appear to promise the enticing advantages of convenience and quick results which could be heightened if such food products were shipped, displayed, cooked, and served in the same package. Unfortunately, these enticing advantages are illusory because certain types of food products, when heated by microwaves, lack many of the characteristics which consumers have come to associate with such products when heated in conventional ovens. The configuration and materials of the package can have a substantial effect upon the results of microwave cooking, but no package has been found which produces entirely satisfactory results when used during microwave cooking of particular foods, such as flour-based food products. Particularly unsatisfactory results occur when such food products are somewhat oval, round, or otherwise irregular in shape, such as rolls, buns, or waffles. To be acceptable, such cooked products must be internally heated without overcooking and must be browned on top, and, if a crust is present, they must be both crisp and brown while avoiding both an overcooked, dried, scorched, burned, or charred effect and an undercooked, cold, doughy effect.

One attempt to solve some of the problems discussed above is disclosed in the patent to Brastad (U.S. Pat. No. 4,267,420). This patent teaches a method for achieving microwave browning of a food item to be heated in a microwave oven by using a packaging material made of a plastic film or other dielectric substrate of sufficient flexibility to allow conformance to the shape of the food item, wherein the conversion of microwave energy to thermal energy occurs in a proximal relationship with the surface portion of the food item. The material, which is flexible, can be supported exteriorly by more rigid dielectric material, such as paperboard. As can be seen in FIG. 3, the overlapping surfaces of the packaging material provide a double heater area on the bottom side of the package. However, Brastad fails to recognize the desirability of providing a container which is shaped and arranged to cause a double heater area to be located in a position beneath the surface area of a food item which affords sufficient shielding to the double heater area by the food item, when the food item and the container are placed in a microwave oven.

Although a number of patents, such as those to Brown, et al. (U.S. Pat. No. 4,590,349) and Maroszek (U.S. Pat. 4,594,492), disclose microwave paperboard packages for use in cooking food products having nonuniform dimensions, including microwave interactive layers for converting microwave energy to heat so as to achieve browning of the food contained therein, none of these packages is suitable both for surface heating contents having an oval, round, or otherwise irregular shape and for browning and crisping food products without the risk of scorching of the package and subsequent scorching of the food due to overlapping microwave interactive layers which generate excess heat when exposed to microwave energy and the risk of excessive shielding due to overlapping which causes generally unpredictable microwave interactivity.

Thus, it has remained an elusive goal in the microwave container art to produce a "cook-in" package for food products having oval, round, or otherwise irregular shape wherein the package is inexpensive, simple to manufacture, disposable and capable of surface heating the food while simultaneously satisfactorily browning and/or crisping the food, and preventing the scorching of the package and subsequent scorching and/or undesirable heating of the food due to overheating of the package's overlapping interactive layers which generate excess heat when exposed to microwave energy.

DISCLOSURE OF THE INVENTION

It is an object of the present invention to provide a novel and improved apparatus for surface heating an object in an oven by microwave energy wherein the apparatus is capable of heating the object in an acceptable manner while simultaneously preventing the scorching of the apparatus and subsequent scorching and/or undesirable heating of the object contained therein.

It is another object of the present invention to provide a novel and improved apparatus for containing an object to be heated in an oven by microwave energy wherein the apparatus includes interactive means for converting microwave energy into heat for heating the exterior surface of the object within the apparatus, and wherein the interactive means includes a flexible layer of microwave interactive material supported in a manner to prevent undesirable overlap.

It is another specific object of the present invention to provide a novel and improved apparatus for surface heating an object in an oven by microwave energy wherein the apparatus includes support means for supporting interactive means in a position which causes an overlap zone of two microwave interactive layers to directly contact the exterior surface of the object in a manner to prevent unpredictable microwave interactivity, when the object and the apparatus are located in operative position within a microwave oven.

It is another specific object of the present invention to provide a novel and improved apparatus for surface heating an object in an oven by microwave energy wherein the apparatus includes support means formed from a unitary blank which is inexpensive, simple to manufacture, and disposable.

It is another specific object of the present invention to provide a novel and improved apparatus for surface heating an object in an oven by microwave energy wherein the apparatus includes a layer of interactive material arranged to cover entirely one of the surfaces of a blank which forms the interior of a sleeve, thus providing an apparatus which is inexpensive and simple to manufacture.

It is another specific object of the present invention to provide a novel and improved apparatus for surface heating an object in an oven by microwave energy wherein the apparatus includes a unitary blank having plural panels hingedly interconnected along fold lines which are positioned and spaced to allow the blank to be folded into a sleeve having open ends so as to form an insert for an outer microwave transparent carton.

It is another specific object of the present invention to provide a novel and improved apparatus for surface heating an irregularly shaped object in an oven by microwave energy wherein the apparatus includes a unitary blank having plural panels hingedly interconnected along fold lines which are positioned and spaced to allow the panels to be brought into close proximity to a corresponding portion of the exterior surface of the irregularly shaped object.

It is another specific object of the present invention to provide a novel and improved apparatus for surface heating an object in an oven by microwave energy wherein the apparatus includes first and second portions which are formed by opposed ends of a unitary blank and which are arranged and adapted to be overlapped and adhered together to form a planar base panel for use in supporting the object when the object and the apparatus are located in operative position within a microwave oven.

It is another specific object of the present invention to provide a novel and improved apparatus for surface heating an object in an oven by microwave energy wherein the apparatus includes first and second portions which are formed by opposed ends of a unitary blank and which are arranged and adapted to be overlapped and adhered together to cause an overlap zone of microwave interactive material to extend longitudinally along the median of the base panel of the apparatus so as to position the interior of the overlap zone in a manner which directly contacts the exterior surface of the object, thereby preventing unpredictable microwave interactivity that may result in undesirable heating or excessive microwave shielding of the object.

It is another specific object of the present invention to provide a novel and improved apparatus for surface heating an object in an oven by microwave energy wherein the apparatus includes support means formed of semi-rigid microwave transparent material, such as paperboard, which can be bent or folded into a configuration which closely corresponds to the cross-sectional configuration of the exterior surface of the object so as to support microwave interactive means in a position that heats the surface of the object in a satisfactory manner while preventing unpredictable microwave interactivity that may result in undesirable scorching of the apparatus and/or undesirable heating or excessive microwave shielding of the object.

It is another specific object of the present invention to provide a novel and improved apparatus for surface heating an object in an oven by microwave energy wherein the apparatus includes interactive means formed of a layer of metallized plastic laminated to semi-rigid material, such as paperboard, which is inexpensive and simple to manufacture.

It is another specific object of the present invention to provide a novel and improved apparatus for surface heating an object in an oven by microwave energy wherein the object is a food product and the apparatus includes interactive means which is arranged to achieve browning and/or crisping of the surfaces of the food product when the food product and the apparatus are located in operative position within a microwave oven.

It is another specific object of the present invention to provide a novel and improved apparatus for surface heating an object in an oven by microwave energy wherein the apparatus includes support means for supporting interactive means in a position adjacent one portion of the surface of the object in a configuration to minimize the amount of overlaps of interactive material to no more than two layers of interactive material restricted to a zone wherein the overlap zone is positioned to utilize the maximum possible amount of microwave shielding by the object when the object and apparatus are located in operative position within a microwave oven.

The above and other objects and advantages of the invention are achieved by a stand alone sleeve or an insert for an outer microwave transparent carton including a unitary blank having plural panels hingedly interconnected along fold lines which are positioned and spaced to allow the blank to be folded into a sleeve having open ends and to allow the panels to be brought into close proximity to a corresponding portion of the exterior surface of the object. A flexible layer of microwave interactive material is arranged to cover entirely one of the surfaces of the blank which forms the interior of the sleeve. First and second portions are formed by opposed ends of the blank and are adapted to be overlapped and adhered together to form a planar base panel for use in supporting an object to be heated in an oven by microwave energy. The first and second portions are arranged to cause the area of overlap to extend longitudinally along the median of the base panel and may be positioned such that the interior of the area of overlap directly contacts the exterior surface of the object. The object may have an irregularly shaped exterior surface. The blank is formed of semi-rigid material, such as paperboard. The panels may include a top panel, a pair of opposed side panels hingedly interconnected to the top panel, and a base panel hingedly interconnected to each of the side panels. The panels may form a sleeve that is rectangular in shape. The interactive means may be formed of a layer of metallized plastic laminated to the paperboard. The object to be heated may be a food product, such as a roll, a bun, or a waffle, and the interactive means may be arranged to achieve browning and/or crisping of the surfaces of the food product.

Other and more specific objects of the invention may be understood from the following Brief Description of the Drawings and Best Mode for Carrying Out the Invention.

BEST MODE FOR CARRYING OUT THE INVENTION

Figure 1:
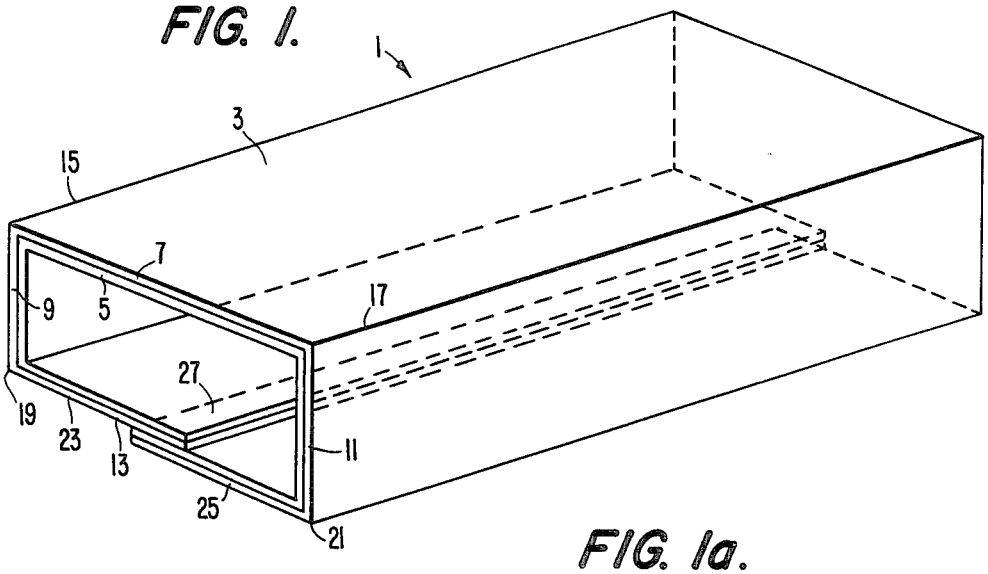
FIG. 1 is a perspective view of an embodiment of a microwave insert constructed in accordance with the present invention.

Shown in FIG. 1 is a microwave insert 1 designed in accordance with the subject invention for use in an outer microwave transparent carton (not shown) for surface heating an object, such as a food product, in a microwave oven. The insert 1 includes a unitary blank 3 and a microwave interactive layer 5. The unitary blank has plural panels 7, 9, 11 and 13 which are hingedly interconnected by parallel, longitudinal fold lines 15, 17, 19 and 21, which are positioned and spaced to allow the blank 3 to be folded into a rectangular sleeve having open ends. More particularly, the blank includes a top panel 7, a pair of opposed side panels 9 and 11, and a base panel 13. The side panels 9 and 11 are hingedly interconnected to the top panel 7 by fold lines 15 and 17, respectively. The base panel 13 is hingedly interconnected to the side panels 9 and 11 by fold lines 19 and 21, respectively. The base panel 13 includes a first portion 23 and a second portion 25 which are formed by opposed ends of the blank. The first and second portions 23 and 25 are adapted to be overlapped and adhere together to form the planar base panel 13. The first and second portions 23 and 25 are thus arranged to cause an overlap zone 27 to extend longitudinally along the median of the base panel 13. The microwave interactive layer 5 is bonded to and arranged to cover entirely one of the surfaces of the blank 3 which forms the interior of the sleeve, thus providing an apparatus which is inexpensive and simple to manufacture. The blank 3 is formed of semi-rigid, microwave transparent material, such as paperboard. However, other types of semi-rigid, microwave transparent material may be used. This interactive layer 5 has the characteristics of the interactive layers disclosed by Brown, et al. in U.S. Pat. No. 4,590,349 and Maroszek in U.S. Pat. No. 4,594,492 in that the layer 5 is constructed from a metallized plastic which is laminated onto the blank 3. The material of the layer 5 is capable of converting into heat at least a portion of the microwave energy impinging on the layer 5.

Figure 1A:
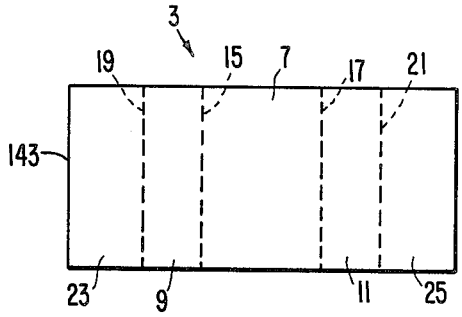
FIG. 1*a* is a plan view of a paperboard blank from which the microwave insert of FIG. 1 may be formed.

Shown in FIG. 1*a* is a plan view of the unitary blank 3 shown in FIG. 1. The blank 3 includes the top panel 7, the side panels 9 and 11 which are hingedly connected to the top panel 7 by fold lines 15 and 17, respectively, and the first and second portions 23 and 25 which are hingedly interconnected to the side panels 9 and 11 by the fold lines 19 and 21, respectively. Adhesive 143 may be applied to the edge of the first portion 23, as can be seen in FIG. 1*a*. The use of a unitary blank, as opposed to multiple blanks, provides an apparatus which is inexpensive and simple to manufacture.

Figure 2A:
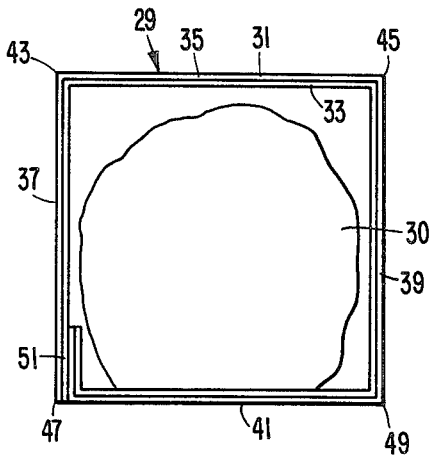
FIG. 2a. (PRIOR ART)
FIG. 2*a* is an end view of a prior art microwave insert including a food product contained therein.

Shown in FIG. 2*a* is a microwave insert 29 designed in accordance with the prior art, including an object 30, such as a food product, contained therein. The insert 29 includes a unitary blank 31 and a microwave interactive layer 33. The layer 33 is bonded to and arranged to cover entirely one of the surfaces of the blank 31 which forms the interior of a rectangular sleeve. The insert 29 includes a top panel 35, a pair of opposed side panels 37 and 39, and a bottom panel 41. The side panels 37 and 39 are hingedly interconnected to the top panel 31 by fold lines 43 and 45, respectively. The base panel 41 is hingedly interconnected to the side panels 37 and 39 by fold lines 47 and 49, respectively. The opposed ends of the blank are arranged and adapted to be overlapped and adhered together to form an overlap zone 51 which extends along the bottom of the side panel 37. As can be seen by reference to FIG. 2*a*, the overlap zone 51 does not directly contact the food product 30. Thus, the insert shown in FIG. 2*a* fails to position the overlap zone in a manner to utilize the maximum possible amount of microwave shielding by the food product 30, when the food product 30 and the insert 29 are located in operative position within a microwave oven.

Figure 2B:
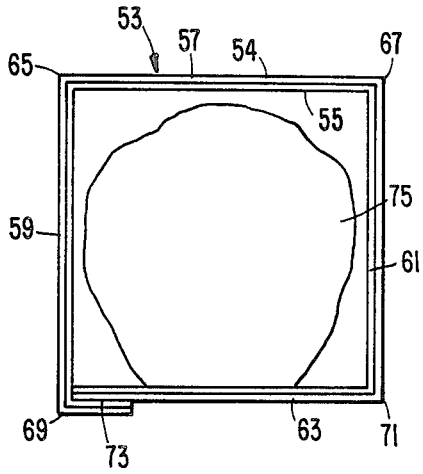
FIG. 2b. (PRIOR ART)
FIG. 2*b* is an end view of another prior art embodiment of a microwave insert including a food product contained therein.

Shown in FIG. 2*b* is another microwave insert 53 designed in accordance with the prior art, including a food product 75 contained therein. The insert 53 also includes a unitary blank 54 and a microwave interactive layer 55. The microwave interactive layer 55 is bonded to and arranged to cover entirely one of the surfaces of the blank 54 which forms the interior of a sleeve. The insert 53 includes a top panel 57, a pair of opposed side panels 59 and 61, and a base panel 63. The side panels 59 and 61 are hingedly connected to the top panel 57 by fold lines 65 and 67, respectively. The base panel 63 is hingedly interconnected to the side panels 59 and 61 by fold lines 69 and 71, respectively. The opposed ends of the blank 54 are arranged and adapted to be overlapped and adhere together to form an overlap zone 73 which extends along the side of the base panel 63. Thus, the insert 53, as shown in FIG. 2*b*, fails to position the overlap zone 73 in a manner to utilize the maximum possible amount of microwave shielding by a food product 75 when the food product 75 and the insert 53 are located in operative position within a microwave oven. The embodiment of the insert 1 shown in FIG. 1 improves over the prior art shown in FIG. 2*a* and FIG. 2*b* by providing a blank 3 wherein plural panels 7, 9, 11 and 13 are defined and hingedly interconnected by fold lines 15, 17, 19 and 21 which are positioned and spaced to allow the blank 3 to be folded into an open-ended sleeve having a planar base panel 13 formed by first and second portions 23 and 25 which are arranged to cause an overlap zone 27 of microwave interactive material to be positioned beneath the major axes or diameter of an object contained therein so as to utilize the maximum possible amount of microwave shielding by the object when the object and the insert 1 are located in operative position within a microwave oven.

Figure 3:
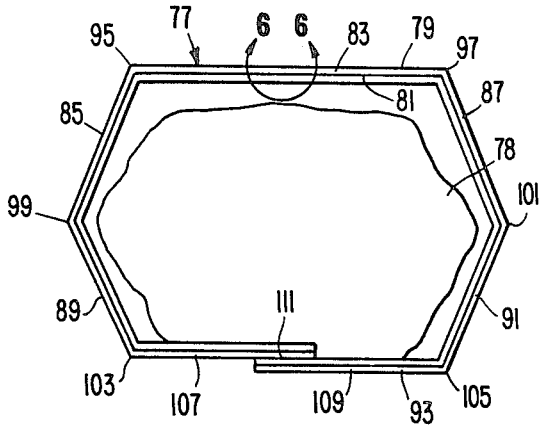
FIG. 3 is an end view of an alternative embodiment of a microwave insert constructed in accordance with the present invention, including a food product contained therein.

Shown in FIG. 3 is a microwave insert 77 designed in accordance with the subject invention and a food product 78 contained therein. The insert 77 includes a unitary blank 79 and a microwave interactive layer 81. The microwave interactive layer 81 is bonded to and arranged to cover entirely one of the surfaces of the blank 79 which forms the interior of a sleeve. The insert 77 includes a top panel 83, inclined side panels 85, 87, 89 and 91, and a base panel 93. The side panels 85 and 87 are hingedly interconnected to the top panel 83 by fold lines 95 and 97, respectively. The side panels 89 and 91 are hingedly interconnected to the side panels 85 and 87 by fold lines 99 and 101, respectively. The base panel 93 is hingedly interconnected to the side panels 89 and 91 by fold lines 103 and 105, respectively. The food product 78 may have an irregularly shaped exterior surface and the fold lines 95, 97, 99, 101, 103 and 105 are positioned and spaced to allow the panels 83, 85, 87, 89, 91 and 93 to be brought into close proximity to a corresponding portion of the exterior surface of the food product 78. The base panel 93 includes a first portion 107 and a second portion 109 which are formed by opposed ends of the blank 79. The first and second portions 107 and 109 are adapted to be overlapped and adhere together to form an overlap zone 111 to extend longitudinally along the median of the base panel 93.

As can be seen in FIG. 3, the first and second portions 107 and 109 are positioned such that the interior of the overlap zone 111 directly contacts the exterior surface of the food product 78. The insert 77 thus provides an interlap zone 111 which is positioned to utilize the maximum possible amount of microwave shielding by the food product 78 when the food product 78 and the insert 77 are located in operative position within a microwave oven. The embodiment shown in FIG. 3 further improves over the prior art shown in FIG. *2a* and FIG. *2b* by providing an insert 77 including inclined side panels 85, 87, 89 and 91 which are hingedly interconnected by fold lines which are positioned and spaced to allow the side panels 85, 87, 89 and 91 to be configured so as to be brought into close proximity to a corresponding portion of the exterior surface of an irregularly shaped food product 78 contained therein, thereby further preventing unpredictable microwave interactivity and any resulting undesirable heating of the food product 78.

Figure 4:
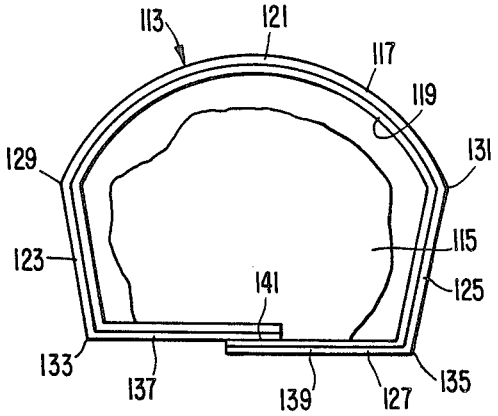
FIG. 4 is an end view of another alternative embodiment of a microwave insert constructed in accordance with the present invention, including a food product contained therein.

Shown in FIG. 4 is another microwave insert 113 designed in accordance with the subject invention and a food product 115 contained therein. The insert 113 includes a unitary blank 117 and a microwave interactive layer 119. The layer 119 is bonded to and arranged to cover entirely one of the surfaces of the blank 117 which forms the interior of a sleeve. The insert 113 includes a convex top panel 121, a pair of opposed, inclined side panels 123 and 125, and a base panel 127. The side panels 123 and 125 are hingedly interconnected to the top panel 121 by fold lines 129 and 131, respectively. The base panel 127 is hingedly interconnected to the side panels 123 and 125 by fold lines 133 and 135, respectively. The base panel 127 includes a first portion 137 and a second portion 139 which are formed by opposed ends of the blank 117. The first and second portions 137 and 139 are arranged and adapted to be overlapped and adhere together to form an overlap zone 141 which extends longitudinally along the median of the base panel 127.

As can be seen in FIG. 4, the food product 115 may have an irregularly shaped exterior surface and the fold lines 129,131, 133 and 135 may be positioned and spaced to allow the panels 121, 123, 125 and 127 to be brought into close proximity to a corrresponding portion of the exterior surface of the food product 115. The first and second portions 137 and 139 are positioned such that the interior of the overlap zone 141 directly contacts the exterior surface of the food product 115. Thus, the insert 113 provides an overlap zone 141 which is positioned to utilize the maximum possible amount of microwave shielding by the food product 115 when the food product 115 and the insert 113 are located in operative position within a microwave oven. The embodiment shown in FIG. 4 further improves over the prior art shown in FIG. *2a* and FIG. *2b* by providing an insert 113 including an arcuate top panel 121 which is hingedly interconnected to side panels 123 and 125, which may be vertical or inclined, by fold lines 129 and 131, respectively, so as to allow the top panel 121 to be bent, thus allowing the insert to assume a configuration which closely corresponds to the cross-sectional configuration of the exterior surface of an irregularly shaped food product 115 contained therein, thereby further preventing unpredictable microwave interactivity and any resulting undesirable heating of the food product 115.

Figure 5:
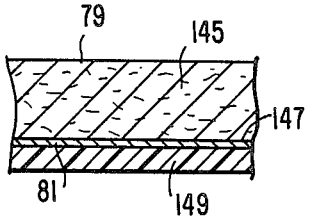
FIG. 5 is an enlarged, broken away cross-sectional view of the material of the microwave insert of FIG. 3, taken along lines 6—6.

Shown in FIG. 5 is an enlarged, broken away cross-sectional view of the material of the microwave insert of FIG. 3, taken along line 6—6. The unitary blank 79 is formed of paperboard 145, and the microwave interactive layer 81 is formed of a metallic layer 147 and a plastic layer 149 which are laminated to the paperboard 145.

INDUSTRIAL APPLICABILITY

The disclosed invention has particular utility in the packaging of food products for distribution and sale in refrigerated and frozen display cases now common in most grocery stores. The disclosed apparatus is ideally suited for packaging, shipping, vending, and microwave heating of a variety of food products, but is especially useful in conjunction with flour-based food products, such as buns or waffles, that are round, oval, or irregularly shaped.

I claim:

1. An apparatus for surface heating an object in an oven by microwave energy, comprising:

(a) interactive means for converting microwave energy into heat, said interactive means including a flexible layer of microwave interactive material; and (b) support means supporting said interactive means and forming a stand alone sleeve or insert having a predetermined shape during use, including a base panel defined in part between a set of opposed edge regions, said sleeve or insert having an area of overlap of interactive material, wherein there are no more than two layers of interactive material at said area of overlap, said area of overlap is located along said base panel space inwardly and away from said opposed edge regions whereby said overlap area is positioned to maximize the amount of microwave shielding by the object when the object and apparatus are located in operative position within a microwave oven to prevent the scorching of the apparatus and undesirable heating of the object.

2. An apparatus as defined in claim 1, wherein said support means is formed from a unitary blank and includes first and second portions adapted to be overlapped when said support means is supporting the object, said first and second portions being formed by opposed ends of said blank.

3. An apparatus as defined in claim 2, wherein said unitary blank has plural panels hingedly interconnected along fold lines.

4. An apparatus as defined in claim 3, wherein said fold lines are positioned and spaced to allow said blank to be folded into a sleeve having open ends.

5. An apparatus as defined in claim 4, wherein the object may have an irregularly shaped exterior surface and wherein said fold lines are spaced to allow said panels to be brought into close proximity to a corresponding portion of said exterior surface of the object.

6. An apparatus as defined in claim 4, wherein said layer of interactive material is arranged to cover entirely one of the surfaces of said blank which forms the interior of said sleeve.

7. An apparatus as defined in claim 4, wherein said sleeve forms an insert for an outer microwave transparent carton.

8. An apparatus as defined in claim 7, wherein said support means is formed of semi-rigid material.

9. An apparatus as defined in claim 8, wherein said interactive means is formed of a layer of metallized plastic laminated to said semi-rigid material.

10. An apparatus as defined in claim 8, wherein said support means is formed of paperboard.

11. An apparatus as defined in claim 2, wherein said first and second portions are adhered together when overlapped to form said planar base panel.

12. An apparatus as defined in claim 8, wherein said first and second portions are arranged to cause said overlap zone to extend longitudinally along the median of said base panel.

13. An apparatus as defined in claim 12, wherein said first and second portions are positioned such that the interior of said overlap zone directly contacts the exterior surface of the object.

14. An apparatus as defined in claim 13, wherein said panels include:

(a) a top panel;

(b) a pair of opposed side panels hingedly interconnected to said top panel; and (c) said base panel hingedly interconnected to each of said side panels.

15. An apparatus as defined in claim 14, wherein said panels form a sleeve that is rectangular in shape.

16. An apparatus as defined in claim 1, in combination with an object to be heated in a microwave oven, wherein the object is a food product.

17. An apparatus as defined in claim 16, wherein said interactive means is arranged to achieve browning and/or crisping of the surfaces of said food product.

18. An apparatus for surface heating an object in an oven by microwave energy, comprising:

(a) support means for supporting the object in a microwave oven, said support means including first and second portions adapted to be overlapped when said support means is supporting the object; and (b) interactive means for converting microwave energy into heat, said interactive means including a layer of microwave interactive material joined to both said first and second portions in a manner to cause an area of overlap of interactive material to be formed when said first and second portions are overlapped, wherein said support means forms a stand alone sleeve or insert having a predetermined shape during use, including a base panel defined in part between a set of opposed edge regions and said area of overlap is located along said base panel spaced inwardly and away from said opposed edge regions in a position beneath the surface area of the object which affords the greatest degree of microwave shielding to said area of overlap by the object when the object and said support means are placed in a microwave oven.

* * * * *